US009716346B2

(12) United States Patent
Hsieh et al.

(10) Patent No.: US 9,716,346 B2
(45) Date of Patent: Jul. 25, 2017

(54) ELECTRICAL CONNECTOR WITH METALLIC SHELL FUNCTIONED AS NEGATIVE TERMINAL

(71) Applicant: FOXCONN INTERCONNECT TECHNOLOGY LIMITED, Grand Cayman (KY)

(72) Inventors: Wen-Yi Hsieh, New Taipei (TW); Zhi-Hui Zhu, Kunshan (CN); Wei-Chung Lin, New Taipei (TW)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 14/806,920

(22) Filed: Jul. 23, 2015

(65) Prior Publication Data

US 2016/0028191 A1 Jan. 28, 2016

(30) Foreign Application Priority Data

Jul. 23, 2014 (CN) ..... 2014 2 0407435 U

(51) Int. Cl.
*H01R 13/6581* (2011.01)

(52) U.S. Cl.
CPC ..... *H01R 13/6581* (2013.01)

(58) Field of Classification Search
CPC ..... H01R 13/6594; H01R 13/6597
USPC ..... 439/289, 446, 218, 131, 607.34, 607.35, 439/607.36, 607.4, 668
See application file for complete search history.

(56) References Cited

U.S. PATENT DOCUMENTS 5,147,230 A * 9/1992 Plyler ..... H01R 13/187 439/843
6,270,379 B1 * 8/2001 Huang ..... H01R 12/716 439/607.34
8,579,665 B2 * 11/2013 Yu ..... H01R 12/724 439/607.35
2005/0124220 A1 * 6/2005 Wang ..... G02B 6/3817 439/607.35
2006/0105630 A1 * 5/2006 Zhang ..... H01R 13/6581 439/607.01
2006/0128219 A1 * 6/2006 Zhang ..... H01R 23/6873 439/607.55

(Continued)

FOREIGN PATENT DOCUMENTS

CN 201966366 12/2010

*Primary Examiner* — Tulsidas C Patel
*Assistant Examiner* — Marcus Harcum
(74) *Attorney, Agent, or Firm* — Wei Te Chung; Ming Chieh Chang

(57) ABSTRACT

An electrical connector includes an insulative housing, a positive terminal received in the housing and a metallic shell shielding around the mating portion. The housing has a base portion and a mating portion extending forwardly from the base portion. The metallic shell shields around the mating portion to form a first mating cavity opening forwardly and surrounding an outer surface of the mating portion. The mating portion has a second mating cavity recessed from a front face thereof to be separated from the first mating cavity and opening forwardly. The positive terminal has a contacting portion exposed in the second mating cavity. The metallic shell has at least one elastic pressing portion extending into the first mating cavity to be used as a negative terminal.

8 Claims, 5 Drawing Sheets

(56) References Cited

U.S. PATENT DOCUMENTS

| | | | | |
|---|---|---|---|---|
| 2008/0032552 | A1* | 2/2008 | Ko | H01R 12/707 439/581 |
| 2011/0034080 | A1* | 2/2011 | Su | H01R 27/00 439/607.01 |
| 2011/0111644 | A1* | 5/2011 | Jin | H01R 13/642 439/668 |
| 2014/0099824 | A1* | 4/2014 | Chou | H01R 9/032 439/620.15 |

* cited by examiner

ELECTRICAL CONNECTOR WITH METALLIC SHELL FUNCTIONED AS NEGATIVE TERMINAL

BACKGROUND OF THE INVENTION

1. Field of the Invention

The present invention generally relates to an electrical connector, and more particularly to an electrical connector with a metallic shell functioned as a negative terminal.

2. Description of Related Art

Chinese utility patent issued NO. 201966366 discloses a power connector comprising an insulative housing, a positive terminal and a negative terminal received in the insulative housing and a metallic shell shielding around the insulative housing. The insulative housing has a first receiving room recessed from a front face thereof along a front-to-back direction. The insulative housing has a block portion protruding forwardly into the first receiving room from an inner surface thereof. The block portion defines a second receiving room therein. The positive terminal is disposed in the second receiving room and the negative terminal is disposed in the first receiving room. With the development of the electronic products, the electrical connector is becoming smaller and smaller. Many manufactures are making effort to reduce the elements of the electrical connector to meet the demand aforementioned.

Therefore, a new electrical connector is provided to meet the demand described aforementioned would be desirable.

SUMMARY OF THE INVENTION

Accordingly, an object of the present invention is to provide an electrical connector, a metallic shell of the electrical connector is functioned as a negative terminal.

In order to achieve the object set forth, an electrical connector comprises an insulative housing, a positive terminal received in the housing and a metallic shell shielding around the mating portion. The housing has a base portion and a mating portion extending forwardly from the base portion. The metallic shell surrounds the mating portion to form a first mating cavity opening forwardly and surrounding an outer surface of the mating portion. The mating portion has a second mating cavity recessed from a front face thereof to be separated from the first mating cavity and opening forwardly. The positive terminal has a contacting portion exposed in the second mating cavity. The metallic shell has at least one elastic pressing portion extending into the first mating cavity to be used as a negative terminal.

Other objects, advantages and novel features of the invention will become more apparent from the following detailed description when taken in conjunction with the accompanying drawings.

DETAILED DESCRIPTION OF THE INVENTION

Reference will now be made in detail to the preferred embodiment of the present invention.

Figure 1:
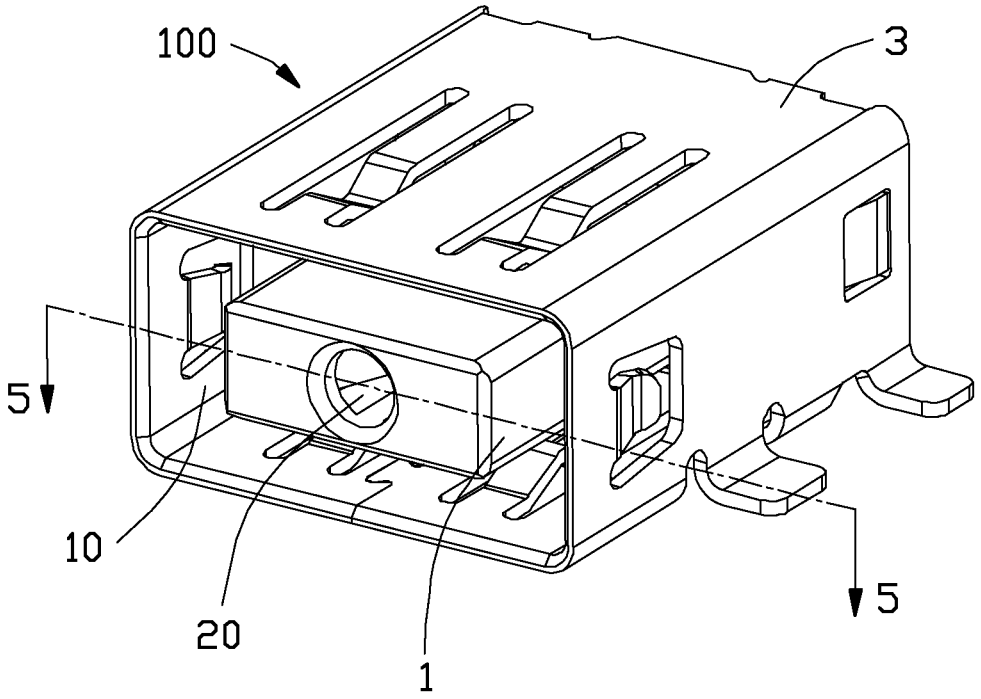
FIG. 1 is a perspective view of an electrical connector of the present invention.
Figure 2:
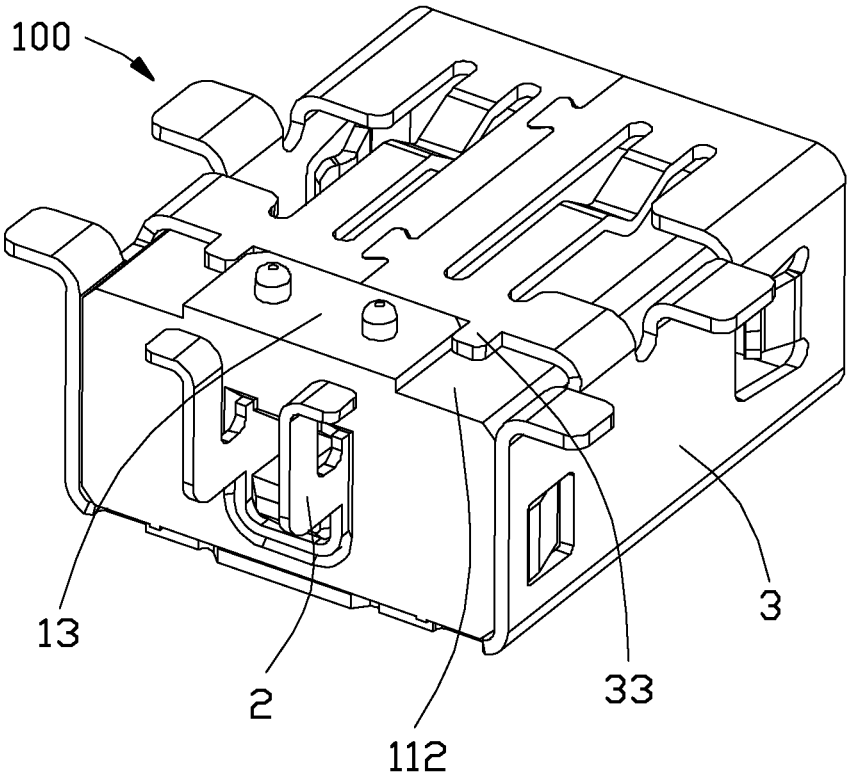
FIG. 2 is another perspective view of the electrical connector shown in FIG. 1.

Referring to FIG. 1 and FIG. 2, the present invention provides with an electrical connector 100 can be used to transmit electric current. The electrical connector 100 comprises an insulative housing 1, a positive terminal 2 received in the housing 1 and metallic shell 3 shielding around the housing 1. Combined with FIG. 3, the housing 1 has a base portion 11 and a mating portion 12 extending forwardly from the base portion 11. The metallic shell 3 surrounds the mating portion 12 to form a first mating cavity 10 opening forwardly. The mating portion 12 has a second mating cavity 20 opening forwardly. The second mating cavity 20 is recessed rearwards from a front face of the mating portion 12 along a front-to-back direction. The second mating cavity 20 is disposed in an inside position of the first mating cavity 10. The first mating cavity 10 and the second mating cavity 20 are separated by a partition wall 121 of the mating portion 12 to form two different rooms. The partition wall 121 of the mating portion 12 has four side walls surrounding to form the second mating cavity 20 and is located between the first and second mating cavity 10, 20. The positive terminal 2 has at least a contacting portion 22 exposed in the second mating cavity 20 and at least a connecting portion 23 extending out of the housing 1. In the present embodiment, the positive terminal 2 has two opposite contacting portions 22 to clip a terminal of a complementary connector and two connecting portions 23 soldered onto a printed circuit board. The metallic shell 3 has at least one elastic pressing portion 31 extending into the first mating cavity 10 and used as a negative terminal. The positive terminal 2 and the pressing portion 31 is spaced from each other by the partition wall 121.

Figure 3:
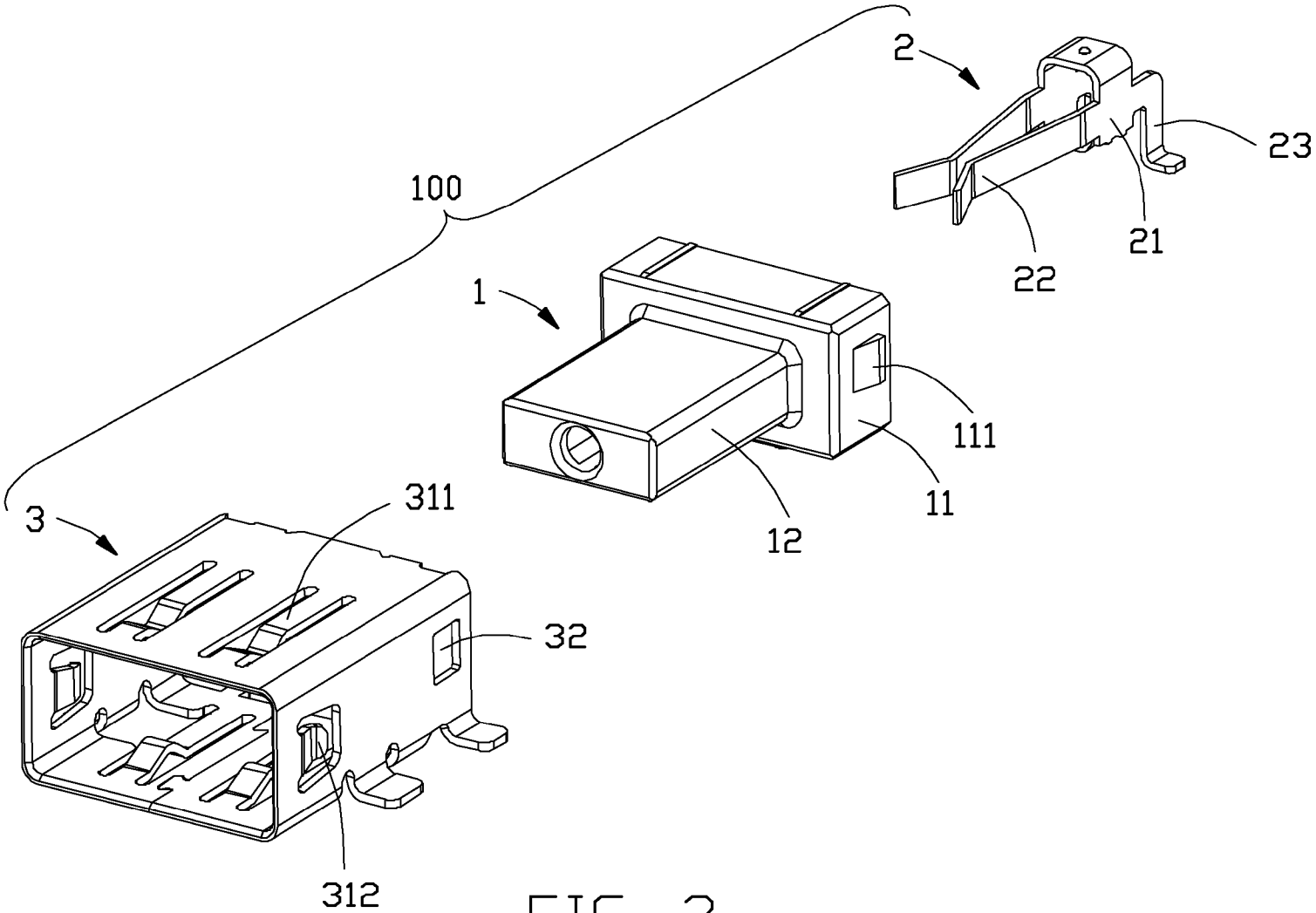
FIG. 3 is an exploded perspective view of the electrical connector shown in FIG. 1.
Figure 4:
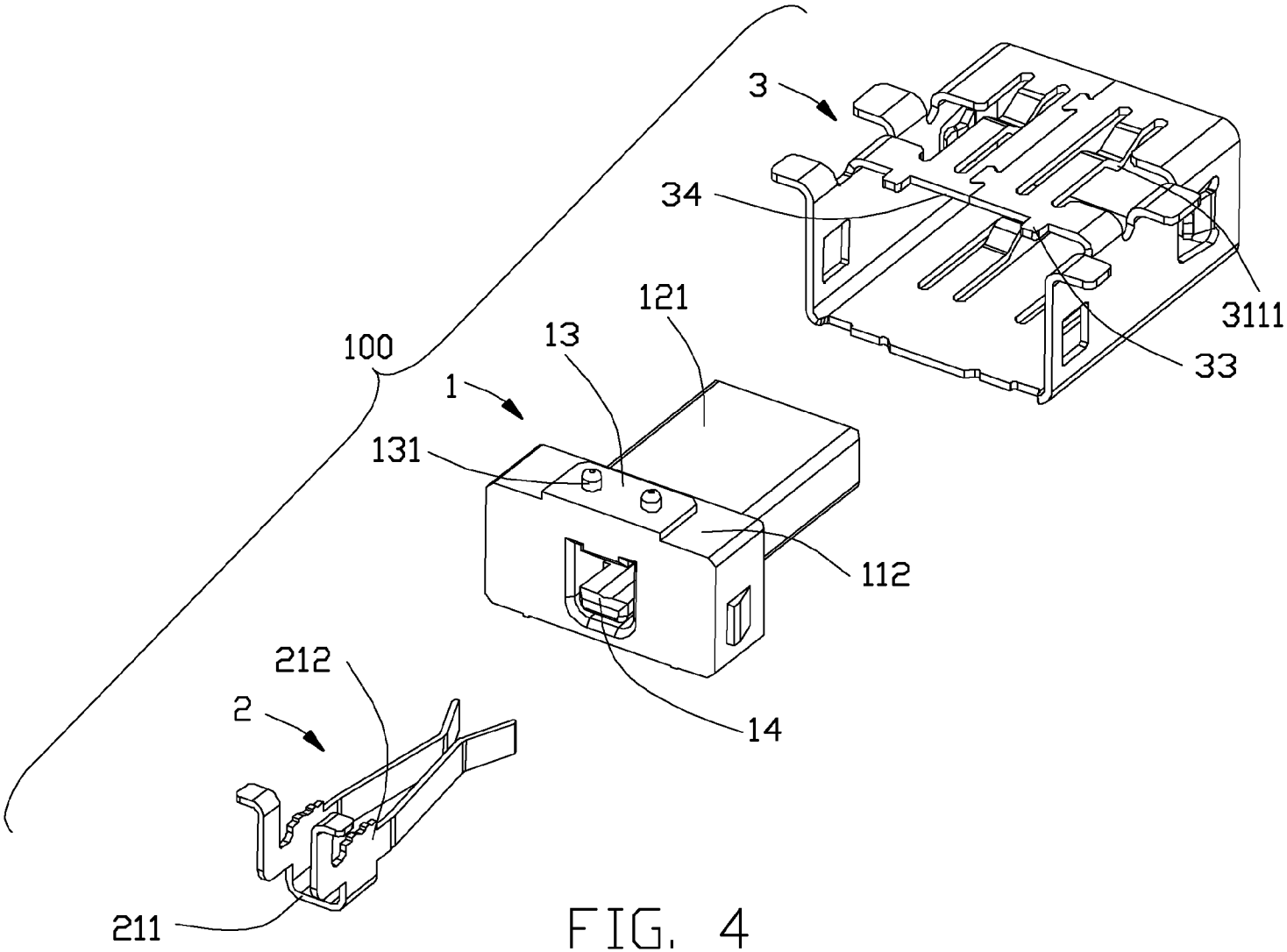
FIG. 4 is another exploded perspective view of the electrical connector shown in FIG. 3.

Referring to FIG. 3 and FIG. 4, the positive terminal 2 has a U-shaped retaining portion 21 connecting the two contacting portions or spring arms 22 and the two connecting or soldering portions 23. The retaining portion 21 connects with rear ends of the two contacting portions 22, and the two contacting portions 22 extends forwardly from the retaining portion 21 along a same direction to get a certain clamping strength therebetween. Each of the two connecting portions 23 extends initially rearwards and then downwardly and at last bended outwardly, thereby the electrical connector 100 is soldered onto the printed circuit board by SMT method. Combined with FIG. 5, the second mating cavity 20 extends rearwards through a rear face 110 of the base portion 11. The housing 1 has two opposite passageways 14 in an inner surface of the partition wall 121 and communicating with the second mating cavity 20. The passageways 14 extend rearwards through the rear face 110 of the base portion 11. The positive terminal 2 is received in the passageways 14, the retaining portion 21 is retained in the passageways 14 and each contacting portion 22 is received and movable in a corresponding passageway 14. What's more, the retaining portion 21 of the positive terminal 2 has two interfering portions 212 retained in the passageways 14 and a U-shaped connecting section 211 connecting with the two interfering portions 212. The housing 1 has a cantilever beam/tongue 141 extending into the second mating cavity 20 to retain the connecting section 211. The positive terminal 2 is assembled into the second mating cavity 20 of the housing 1 along a rear-to-front direction and retained in the passageways 14.

The housing 1 embodied with the positive terminal 2 is assembled into the metallic shell 3 along a rear-to-front direction. The metallic shell 3 has two opposite protruding portions 33 extending rearwards from a rear side edge thereof to form a resisting notch 34 therebetween. The base portion 11 of the housing 1 has a resisting block 13 at a lower surface thereof which is assembled into the resisting notch 34 in the rear-to-front direction. The resisting block 13 protrudes downwardly relative to the lower surface of the base portion 11 and disposed in a middle area of the lower surface of the base portion 11. A rear face of the resisting block 13 and a rear face of the base portion 11 are in a same plane. The resisting block 13 is located behind a front face of the base portion 11. The base portion 11 has an engagement face 112 in a peripheral area of the resisting block 13 for engaging with the metallic shell 3 and the protruding portions 33 of the metallic shell 3. The protruding portions 33 abut against the base portion 11 and are located at two sides of the resisting block 13. The base portion 11 further has two retaining posts 131 extending downwardly from a lower surface of the resisting block 13 to fix the electrical connector 100 onto a printed circuit board.

In the present invention, the pressing portions 31 include four first pressing portions 311 and two second pressing portions or spring tangs 312 extending into the first mating cavity 10 from the metallic shell 3. The four first pressing portions 311 are averagely disposed at two long side walls (not labeled) and the two second pressing portions 312 are separately disposed at two short side walls (not labeled). The first pressing portion 311 has a contacting section 3111 protrudes inwardly into the first mating cavity 10, two opposite ends of the contacting section 3111 connect with the metallic shell 3. The second pressing portion 312 is configured as cantilever shape.

Figure 5:
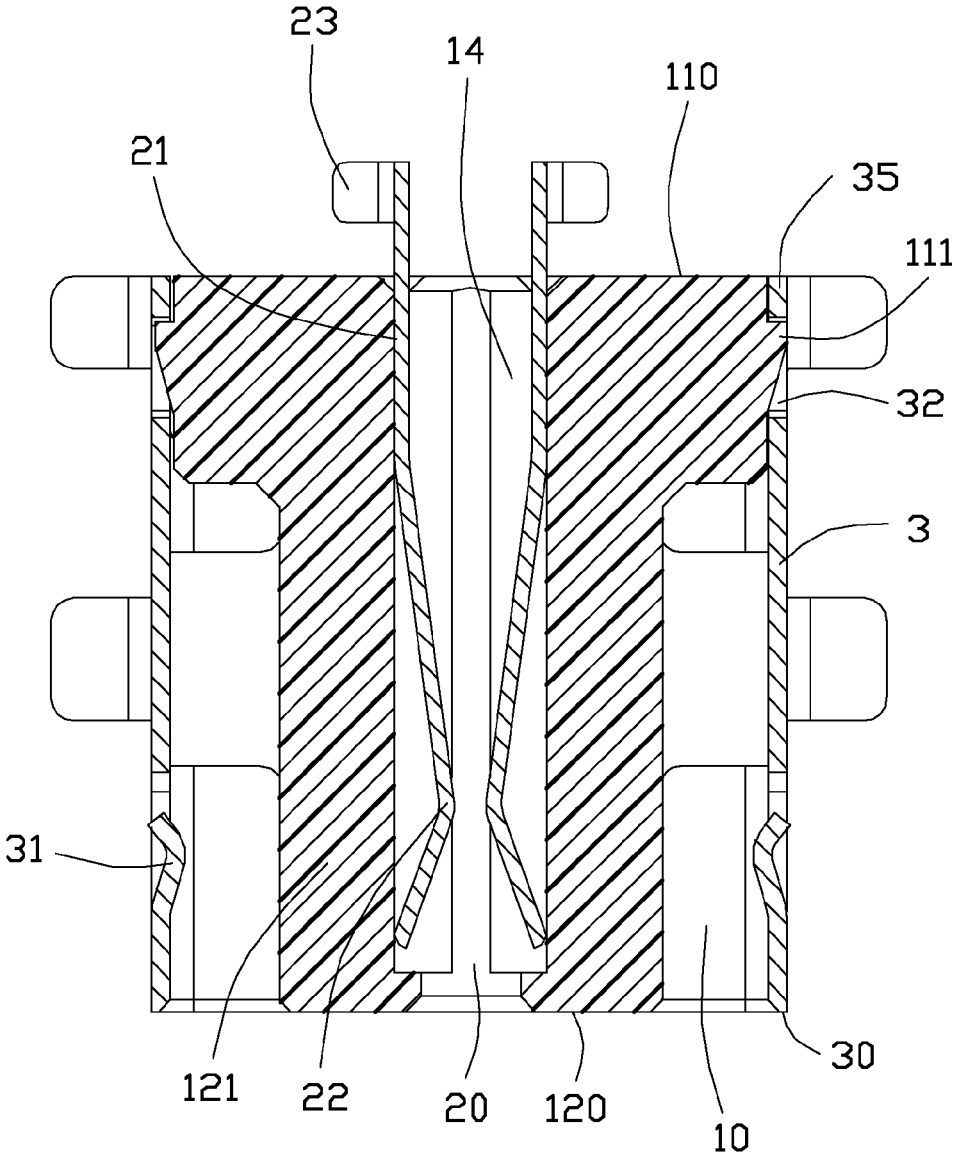
FIG. 5 is a cross-sectional view taken along line 5-5 of FIG. 1.

Referring to FIG. 5, a front face 120 of the mating portion 12 and a front side edge 30 of the metallic shell 3 are in a same plane, a rear face 110 of the base portion 11 and a rear side edge 35 are in a same plane. The base portion 11 has two latching blocks 111 at two sides thereof, and the metallic shell 3 has two corresponding latching holes 32 latching with the latching blocks 111.

In view of the description aforementioned, it is clear that the metallic shell 3 defines the at least an elastic pressing portion 31 extending inwards into the first mating cavity 10 to be used as a negative terminal, which is benefit for reducing the number of the elements of the electrical connector, and further to reduce the producing cost.

It is to be understood, however, that even though numerous characteristics and advantages of the present invention have been set forth in the foregoing description, together with details of the structure and function of the invention, the disclosure is illustrated only, and changes may be made in detail, especially in matters of shape, size, and arrangement of parts within the principles of the invention to the full extent indicated by the broad general meaning of the terms in which the appended claims are expressed.

We claim:

1. An electrical connector comprising:

an insulative housing including a rectangular base portion with a cross-section defined by a long side in a transverse direction and a short side in a vertical direction perpendicular to said transverse direction, and a rectangular mating portion forwardly extending therefrom in a front-to-back direction perpendicular to both said transverse direction and said vertical direction;

a metallic shell enclosing the housing in a fixed manner and forming therein a first mating cavity surrounding the mating portion, a second mating cavity formed within the mating portion and circumferentially isolated from the first mating cavity by said mating portion; and a conductive contact retained in the housing and including a pair of spring arms extending into the second mating cavity and opposite to each other in the transverse direction; wherein the metallic shell includes a pair of spring tangs extending inwardly into the first mating cavity; wherein the contact has an upside-down symmetrical U-shaped retaining portion from which the pair of spring arms symmetrically extend forwardly, and said retaining portion is retained in the base portion to surround a rearwardly extending cantilevered tongue.

2. The electrical connector as claimed in claim 1, wherein the contact includes a pair of horizontal soldering portions located behind the retaining portion and opposite to each other in the transverse direction.

3. The electrical connector as claimed in claim 2, wherein the housing forms a pair of downwardly extending posts essentially aligned with the pair of corresponding horizontal soldering portions, respectively, in the front-to-back direction.

4. The electrical connector as claimed in claim 3, wherein the shell further includes a pair of soldering sections aligned with and located beside the pair of downwardly extending posts in the transverse direction.

5. The electrical connector as claimed in claim 3, wherein the shell further includes a pair of locking holes located above and aligned with said pair of soldering sections in the vertical direction, and the base portion includes a pair of locking blocks received within the pair of locking holes, respectively.

6. The electrical connector as claimed in claim 1, wherein the base portion forms a pair of passageways to receive a pair of interfering portions of the U-shaped retaining portion.

7. The electrical connector as claimed in claimed 12, wherein the pair of spring tangs are opposite to each other in the transverse direction.

8. The electrical connector as claimed in claim 7, wherein the shell further forms two pairs of pressing portions each extending inwardly in a curved manner with two opposite ends linked to the shell.

* * * * *